US007382695B2

(12) United States Patent
Matsui

(10) Patent No.: US 7,382,695 B2
(45) Date of Patent: Jun. 3, 2008

(54) COMPOSITE SWITCH, AND ELECTRONIC EQUIPMENT AND ELECTRONIC TIMEPIECE WHICH POSSESS COMPOSITE SWITCH

(75) Inventor: Tsuyoshi Matsui, Chiba (JP)

(73) Assignee: Seiko Instruments Inc. (JP)

( * ) Notice: Subject to any disclaimer, the term of this patent is extended or adjusted under 35 U.S.C. 154(b) by 504 days.

(21) Appl. No.: 11/088,062

(22) Filed: Mar. 23, 2005

(65) Prior Publication Data

US 2005/0219954 A1 Oct. 6, 2005

(30) Foreign Application Priority Data

Mar. 30, 2004 (JP) ..... 2004-100492

(51) Int. Cl.

| | |
|---|---|
| ***G04C 17/00*** | (2006.01) |
| ***G04C 19/00*** | (2006.01) |
| ***H01H 13/70*** | (2006.01) |
| ***H01H 15/02*** | (2006.01) |
| ***H01H 13/14*** | (2006.01) |
| ***H01H 25/04*** | (2006.01) |

(52) U.S. Cl. ..... 368/69; 200/5 R; 200/548; 200/552

(58) Field of Classification Search ..... 368/69, 368/88, 281, 288, 290, 308, 319–321; 200/5 R, 200/5 EA, 18, 547, 548, 551, 552
See application file for complete search history.

(56) References Cited

U.S. PATENT DOCUMENTS 3,770,921 A * 11/1973 Wilbrecht ..... 200/551
4,506,119 A * 3/1985 Tanabe ..... 200/16 C
5,147,990 A * 9/1992 Dionisio et al. ..... 200/16 R
5,508,479 A * 4/1996 Schooley ..... 200/5 R
5,514,843 A * 5/1996 Wilfong et al. ..... 200/5 R
5,920,042 A * 7/1999 Gotoh ..... 200/5 R
6,703,571 B2 * 3/2004 Nishimoto et al. ..... 200/6 A
7,297,881 B2 * 11/2007 Yamasaki ..... 200/4

FOREIGN PATENT DOCUMENTS

JP 01215288 8/2001

* cited by examiner

*Primary Examiner*—Vit W Miska
(74) *Attorney, Agent, or Firm*—Adams & Wilks

(57) ABSTRACT

To provide a jog switch type composite switch which has a waterproofness and in which a letter scroll is easy. Three button axles corresponding to three individual switches are attached to through-holes of an armoring cover while being made possible to perform a reciprocal movement in an axial direction and through waterproof packings. A button head can be pushed in its intermediate position and is attached to the armoring cover while being made possible to slide in a disposition direction of the button axles. If the button head is pushed in its intermediate position, the center button axle makes only the center individual switch ON. If the button head is slid to an underside, the underside button axle makes only the underside individual switch ON and, if it is slid to an upside, the upside button axle makes only the upside individual switch ON.

9 Claims, 11 Drawing Sheets

COMPOSITE SWITCH, AND ELECTRONIC EQUIPMENT AND ELECTRONIC TIMEPIECE WHICH POSSESS COMPOSITE SWITCH

BACKGROUND OF THE INVENTION

1. Field of the Invention

The present invention relates to a composite switch used in an electronic equipment such as multifunction electronic timepiece.

2. Description of the Prior Art

The electronic timepiece is made the multifunction, and an input work by a switch becomes frequent as well. For example, if it is attempted to input a letter row, the letter row is scrolled by a switch operation from among many letter information such as 50 Japanese syllabary characters of hiragana, 26 letters of alphabet and numerals, thereby deciding one letter desired. In order to perform this by a push-switch, the operation becomes intricate. A rotary switch adopted whereupon in order to solve the above point is obliged from its structure to make an external shape of the electronic timepiece into a circular shape, and thus has a problem that a degree of freedom in design is limited.

In a field other than the electronic timepiece, there is a jog switch made into an input operation structure corresponding to the letter scroll, and a merit in its operability is widely recognized. However, in a product in which this has been mounted, a waterproofness is not taken into consideration. For this reason, the conventional jog switch cannot be adopted in the electronic timepiece.

As the composite switch for the electronic timepiece having the waterproofness, there is one disclosed in JP-A-2001-215288 Gazette (Patent Document 1). This conventional composite switch is a dome type composite switch having a high waterproofness, which comprises plural fixed contacts, movable contacts each of which is supported by an elastic body under a state capable of contacting with or separating from each of the fixed contacts, and plural movable axles each of which has a pressing end part and an operating end part and can axially reciprocate so as to press each of the movable contacts to thereby perform the contact with or the separation from each of the fixed contacts, wherein the operating end part of each of the plural movable axles is retained by being monolithically covered with a soft member such as silicone rubber. However, in a case where this dome type composite switch is adopted in the multifunction timepiece and the letter scroll is performed, since it must be continued to be pressed by a finger from start to end of the scroll, a problem remains in its operability.

<Patent Document 1> JP-A-2001-215288 Gazette

A problem that the present invention is to solve is to provide a jog switch type composite switch used in the electronic equipment such as multifunction electronic timepiece, which has the waterproofness and in which the letter scroll is easy.

SUMMARY OF THE INVENTION

A composite switch solving the above problem is constituted by plural individual switches disposed in one row on a 1st support member, plural button axles disposed while corresponding to each of the plural individual switches and being given spring forces, and a button head having a back face in which there have been formed a center protrusion part and left and right escape parts and disposed such that operating end parts of the plural button axles are selectively pressed by the center protrusion part, and the plural button axles have been attached to through-holes of a 2nd support member while being made possible to perform a reciprocal movement in an axial direction and through waterproof packings, and the button head has been attached to the 2nd support member while being made possible to slide in a disposition direction of the button axles.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

Figure 2:
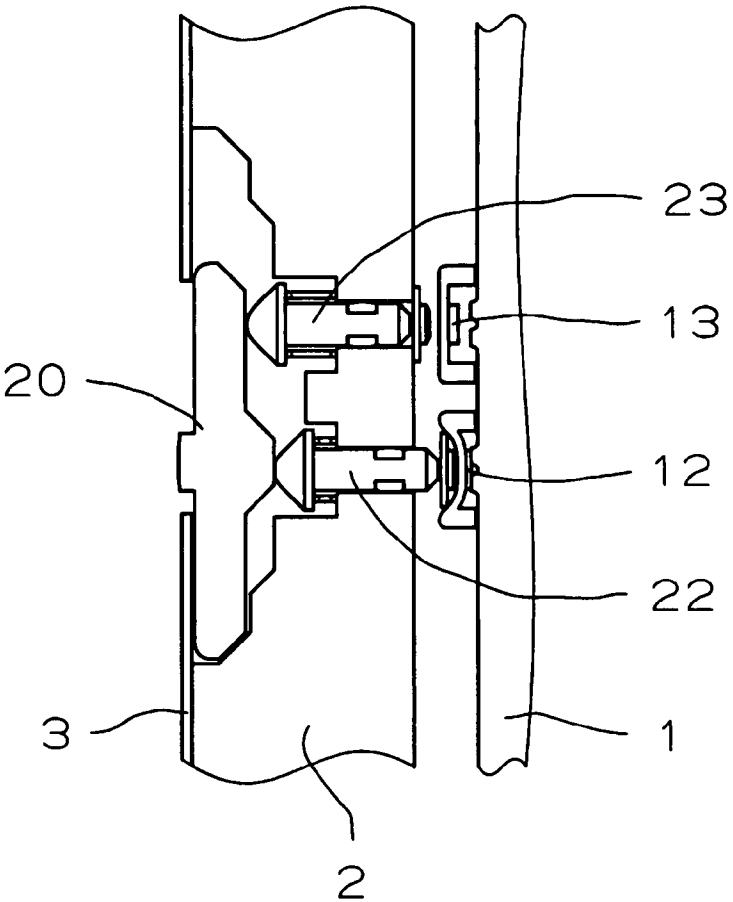
FIG. 2 is a sectional view of the 2-axle type composite switch of the Embodiment 1 of the present invention when the button head exists in its lower position.

The composite switch concerning the present invention is a 3-axle type composite switch possessing three individual switches disposed in one row on a 1st support member with an equal spacing, a button head disposed in a 2nd support member while being made possible to be pushed in its intermediate position and to slide in a disposition direction of the individual switches, and three button axles operated by the button head and driving the individual switches. Incidentally, the button axles are attached to through-holes of the 2nd support member through waterproof packings.

In this 3-axle type composite switch, under a neutral state that the button head exists in its intermediate position and is not pushed, none of the three individual switches is driven. In this 3-axle type composite switch, if the button head is pushed in its intermediate position, only a center individual switch is made ON and, if it is slid to an underside, only an underside individual switch is made ON through an underside button axle and, if it is slid to an upside, only an upside individual switch is made ON through an upside button axle.

That is, this composite switch is one having been constituted by a center individual switch, an underside individual switch and an upside individual switch which have been disposed in one row on a 1st support member, a center button axle, an underside button axle and an upside button axle, which have been disposed while corresponding to each of the three individual switches and being given spring forces, and a button head having a back face in which there have been formed a center protrusion part and left and right escape parts and disposed such that operating end parts of the button axles are selectively pressed by the center protrusion part. And, it is one characterized in that the button axles are attached to through-holes of a 2nd support member while being made possible to perform a reciprocal movement in an axial direction and through waterproof packings, and the button head is attached to the 2nd support member while being made possible to slide in a disposition direction of the button axles and to be pushed in its intermediate position. Additionally, an engaging groove in a slide direction is formed in the center protrusion part of the button head, and an operating end part of the center button axle has an engaging protrusion always engaging with the engaging groove. Further, the underside button axle and the upside button axle are like an arc in section.

Embodiment 1

FIG. 1-FIG. 4 are sectional views of a composite switch, of Embodiment 1, adopted in the multifunction electronic timepiece. The multifunction electronic timepiece, to which the present invention is applied, is one possessing many functions such as basic timepiece function, alarm time display function, chronograph display function, atmospheric pressure display function, and altitude display function. The composite switch concerning the present invention is one used in many mode changeovers such as basic timepiece mode, alarm mode, chronograph mode, atmospheric pressure measuring mode, altitude measuring mode, and time correcting mode.

The composite switch of the Embodiment 1 is a 2-axle type composite switch possessing an underside individual switch 12 and an upside individual switch 13 which have been disposed on a circuit substrate 1 of the multifunction timepiece with a predetermined spacing being provided, a button head 20 which can slide in a disposition direction of the individual switches and has been disposed in an armoring cover 2 of the multifunction timepiece while being made possible to be pushed in its intermediate position, and an underside button axle 22 and an upside button axle 23 which are operated by the button head 20 and drive the individual switches 12 and 13.

The button axles 22 and 23 are attached to through-holes of the armoring cover 2 respectively through waterproof packings 32 and 33, and to them there is given such a spring force as to be moved in a direction toward the button head 20 by each of bias springs 42 and 43.

The button head 20 is a member whose length is a degree slightly exceeding two times of the spacing between the underside button axle 22 and the upside button axle 23 and whose width is a degree slightly exceeding a diameter of each of these button axles. In a back face of the button head 20, there is formed in its center part a center protrusion part 20*a* whose section is trapezoid, and escape parts 20*b* are formed in both sides of the center protrusion part 20*a*. A length of a top face of the center protrusion part 20*a* is a degree of the diameter of the button axle. Operating end parts of the underside button axle 22 and the upside button axle 23, to which the spring forces are given by the bias springs 42 and 43, butt against the escape parts 20*b* in left and right of the button head 20. By this, a surface of the button head 20 is pushed to a head cover 3.

Operating end parts 22*a* and 23*a* of the button axles 22 and 23 are formed like an arc in section. This is for making it possible that the button head 20 having the center protrusion part 20*a* and the escape parts 20*b* can smoothly slide while butting against the operating end part 22*a* of the underside button axle 22 and the operating end part 23*a* of the upside button axle 23.

Each of the underside individual switch 12 and the upside individual switch 13 is a general switch constituted by a fixed contact, a movable contact and an elastic member retaining the movable contact while being separated from the fixed contact by a predetermined spacing, and there is adopted, for example, a dome type switch constituted by one pair of fixed contacts formed on a circuit substrate, a dome type elastic member disposed to the circuit substrate so as to cover these fixed contacts, and a movable contact attached to an inside of the dome type elastic member.

Figure 1:
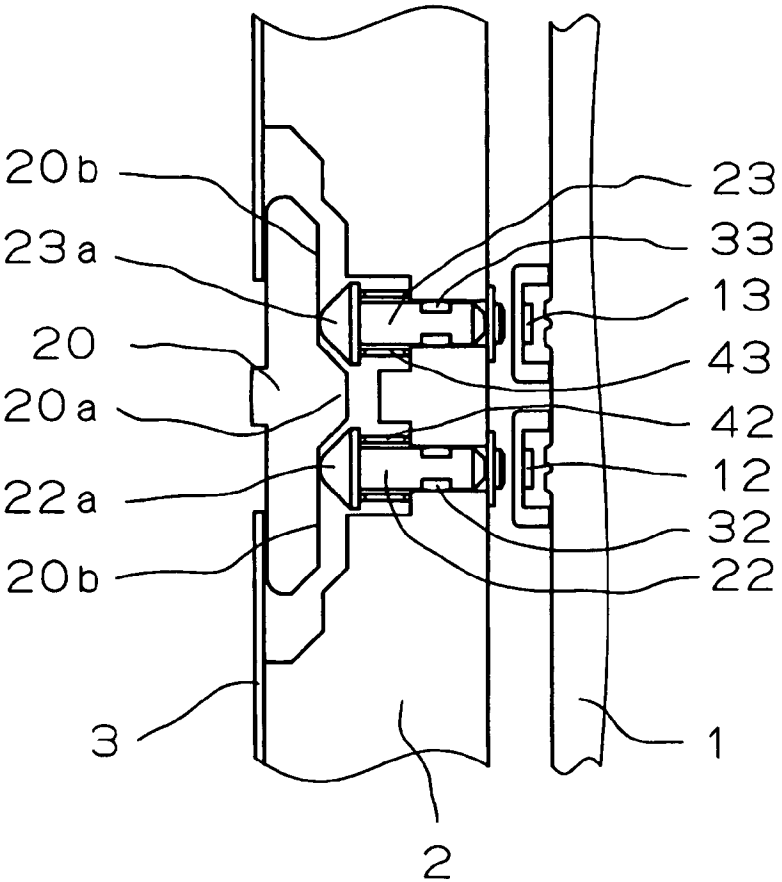
FIG. 1 is a sectional view of a 2-axle type composite switch of Embodiment 1 of the present invention when a button head exists in its intermediate position and is not pushed.

In the 2-axle type composite switch constituted like the above, under a neutral state of FIG. 1 in which the button head 20 exists in its intermediate position and is not pushed, the underside button axle 22 and the upside button axle 23 are moved to directions of the escape parts 20*b* of the button head 20 by each of the bias springs 32 and 33. Under this state, since the center protrusion part 20*a* of the button head 20 engages with none of the operating end part 22*a* of the underside button axle 22 and the operating end part 23*a* of the upside button axle 23, tip parts of the button axles 22 and 23 are separated from the underside individual switch 12 and the upside individual switch 13. Accordingly, under this neutral state, both of the underside individual switch 12 and the upside individual switch 13 are OFF.

In order to make the underside individual switch 12 ON, the button head 20 is slid to an underside as shown in FIG. 2. Thereupon, the center protrusion part 20*a* of the button head 20 engages with the underside button axle 22, thereby moving the button axle 22 to an individual switch side to cause it to contact with the fixed contact, so that the underside individual switch 12 is made ON. Under this state, the upside individual switch 13 is OFF.

Figure 3:
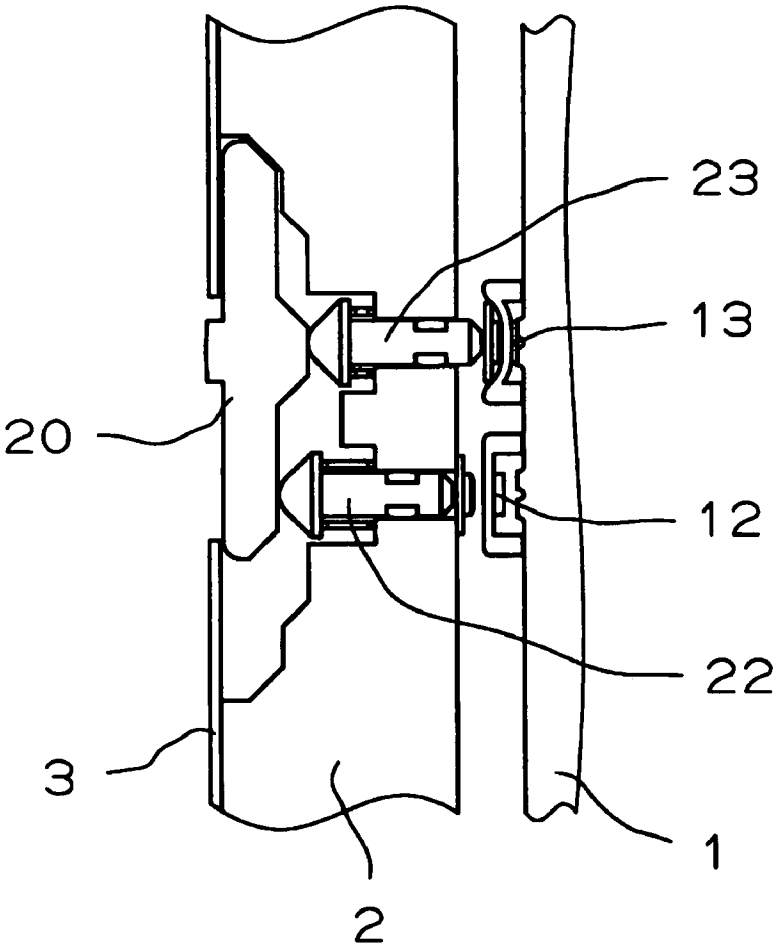
FIG. 3 is a sectional view of the 2-axle type composite switch of the Embodiment 1 of the present invention when the button head has been slid to its upper position.

In order to make the upside individual switch 13 ON, the button head 20 is slid to an upside as shown in FIG. 3. Thereupon, the center protrusion part 20*a* of the button head 20 engages with the upside button axle 23, thereby moving the button axle 23 to an individual switch side. By this, the tip part of the upside button axle 23 pushes the movable contact of the upside individual switch 13 to thereby cause it to contact with the fixed contact, so that the upside individual switch 13 is made ON. Under this state, the underside individual switch 12 is OFF.

Figure 4:
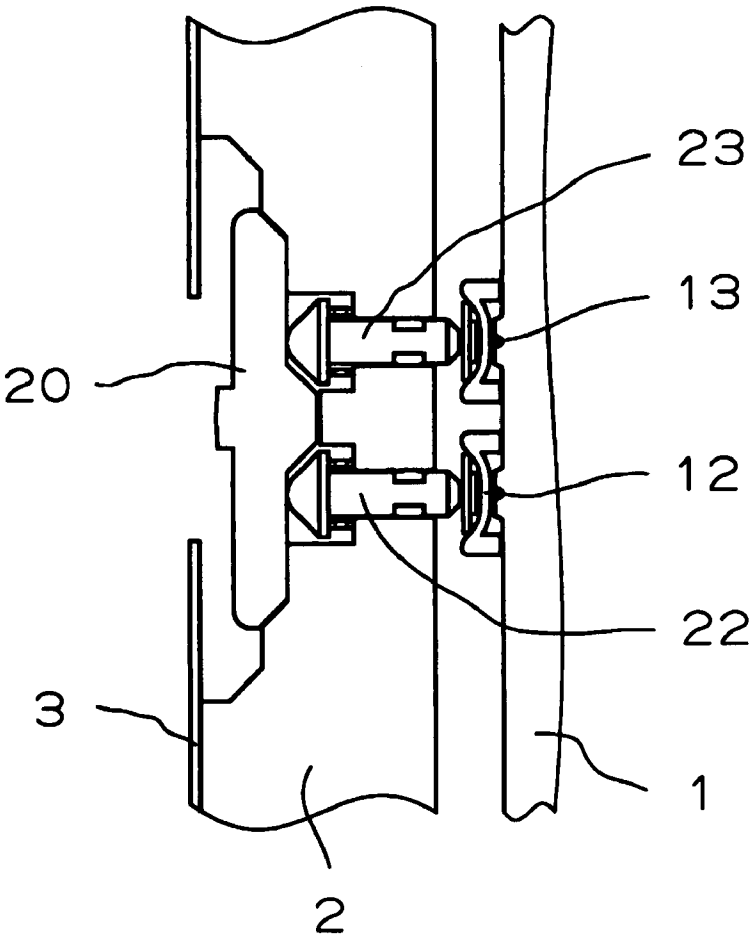
FIG. 4 is a sectional view of the 2-axle type composite switch of the Embodiment 1 of the present invention when the button head exists in its intermediate position and has been pushed.

In order to make both of the underside individual switch 12 and the upside individual switch 13 ON, the button head 20 is slid to its intermediate position and pushed as shown in FIG. 4. Thereupon, the escape parts 20*b* in both sides of the center protrusion part 20*a* of the button head 20 butt against the underside button axle 22 and the upside button axle 23, so that the button axles 22 and 23 are pressed by the button head 20 and moved to the individual switch sides. By this, the tip parts of the button axles 22 and 23 push the movable contacts of the underside individual switch 12 and the upside individual switch 13 to thereby cause them to contact with the fixed contacts, so that both of the underside individual switch 12 and the upside individual switch 13 are made ON.

As mentioned above, the 2-axle type composite switch, of the Embodiment 1, constituted by possessing the underside individual switch 12, the upside individual switch 13, the underside button axle 22, the upside button axle 23, and the button head 20 which can slide in the disposition direction of the individual switches and can be pushed in its intermediate position realizes four changeover states. That is, it is one realizing the four changeover states that only the underside individual switch 12 is made ON, only the upside individual switch 13 ON, both the underside individual switch 12 and the upside individual switch 13 ON, and both the underside individual switch 12 and the upside individual switch 13 OFF. And, the individual switch made ON by sliding the button head 20 is retained to its changeover state during the button head 20 is being retained in that position. Accordingly, in a scroll operation, it becomes unnecessary to continue to push the button head 20, so that the operation has become easy to be performed.

Embodiment 2

FIG. 5-FIG. 8 are sectional views of a composite switch, of Embodiment 2, adopted in the multifunction electronic timepiece. The composite switch of the Embodiment 2 is a 3-axle type composite switch. That is, this composite switch is a 3-axle type composite switch possessing a center individual switch 11, the underside individual switch 12 and the upside individual switch 13 which have been disposed on the circuit substrate 1 of the multifunction timepiece with the predetermined spacing being provided, the button head 20 which can slide in the disposition direction of these three individual switches and has been disposed in the armoring cover 2 while being made possible to be pushed in its intermediate position, and a center button 21, the underside button 22 and the upside button 23 which are operated by the button head 20 and drive the individual switches 11, 12 and 13.

The button axles 21, 22 and 23 are attached to through-holes of the armoring cover 2 of the multifunction timepiece respectively through waterproof packings 31, 32 and 33, and to them there is given such a spring force as to be moved in the direction toward the button head 20 by each of bias springs 41, 42 and 43. A spacing between the underside individual switch 12 and the center individual switch 11 and a spacing between the upside individual switch 13 and the center individual switch 11 are equally selected. Incidentally, a positional relation among the button axles 22 and 23 and the escape parts 20*b* is determined such that, in the neutral position, the operating end parts of the underside button axle 22 and the upside button axle 23 to which the spring forces are given by the bias springs 42 and 43 don't butt against the escape parts 20*b* in left and right of the button head 20.

The button head 20 is a member whose length is a degree slightly exceeding three times of the spacing between the center button axle 21 and the underside button axle 22 and whose width is a degree slightly exceeding the diameter of each of these button axles. In the back face of the button head 20, there is formed in its center part the center protrusion part 20*a* whose section is trapezoid, and the escape parts 20*b* are formed in left and right. A width of a top face of the center protrusion part 20*a* in the disposition direction of the button axles is approximately equal to the spacing between the adjoining button axles. In the center protrusion part 20*a*, there is formed one engaging groove 20*c* in the disposition direction of the button axles.

Figure 15:
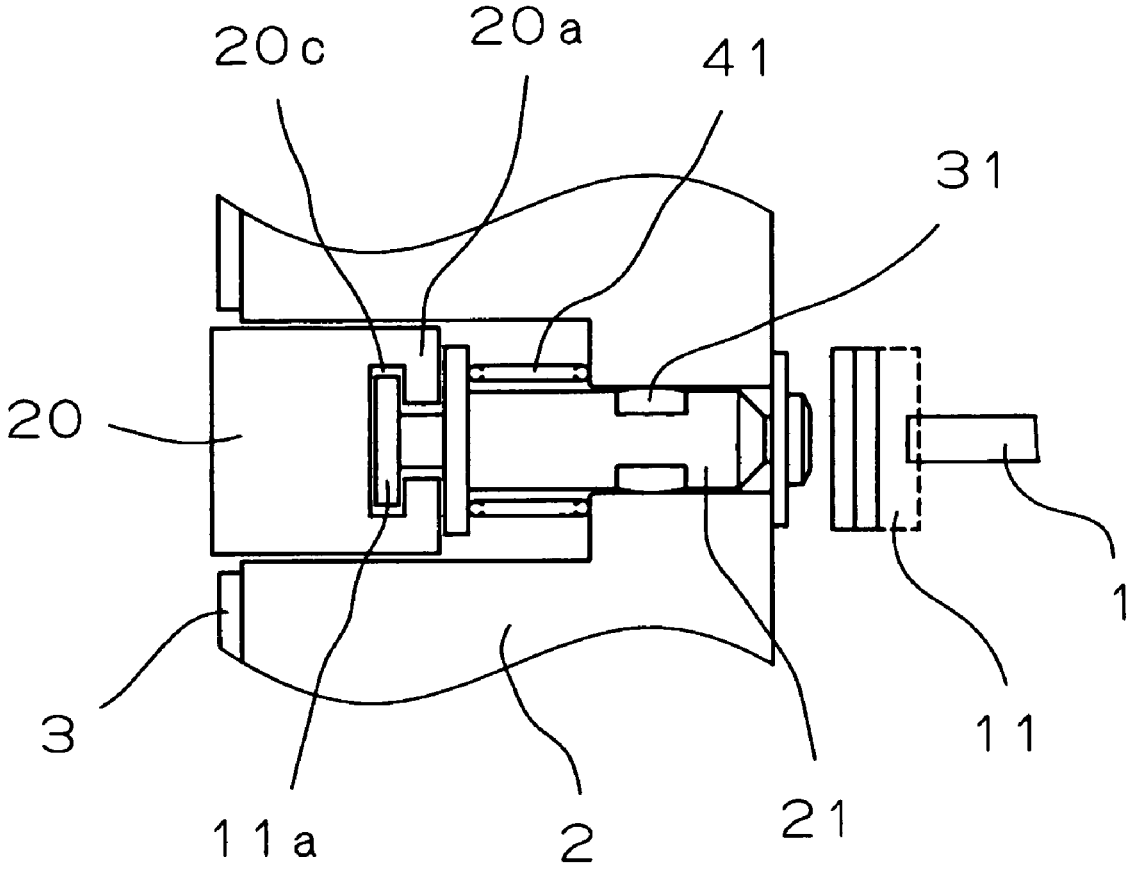
FIG. 15 is a sectional view of the 3-axle composite switch of the Embodiment 2 or the 5-axle composite switch of the Embodiment 3 of the present invention, which is shown by being sectioned in a position of a center button axle.

Further, the engaging groove 20*c* of the center protrusion part 20*a* is a groove of T-shaped section, whose depth from the top face is about a half of the center protrusion part 20*a* as shown in FIG. 15. In order to engage with the engaging part 20*c* of T-shaped section of the center protrusion part 20*a*, an operating end part 21*a* of the center button axle 21 becomes an end part of T-shaped section. The engaging groove 20 of T-shaped section of the center protrusion part 20*a* always engages with the operating end part 21*a* of T-shaped section of the center button axle 21, but there is no fact that the center button axle 21 is pressed even if the button head 20 is slid up and down. Incidentally, a positional relation in the engagement between the button axles 21 and 23 and the center protrusion part 20*a* is determined such that, in the neutral position, a tip part of the center button axle 21 to which the spring force is given by the bias spring 41 does not butt against the center individual switch 11.

Each of an operating end part 22*a* of a 1st underside button axle 22, an operating end part 24*a* of a 2nd underside button axle 24, an operating part 23*a* of a 1st upside button axle 23 and an operating end part 25*a* of a 2nd upside button axle 25 is formed like an arc in section. This is for making it possible that the button head 20 having the center protrusion part 20*a* in the center and the escape parts 20*b* in left and right can smoothly slide while butting against the operating end part 22*a* of the 1st underside button axle 22, the operating end part 24*a* of the 2nd underside button axle 24, the operating part 23*a* of the 1st upside button axle 23 and the operating end part 25*a* of the 2nd upside button axle 25.

For the center individual switch 11, a 1st underside individual switch 12, a 2nd underside individual switch 14, a 1st upside individual switch 13 and a 2nd upside individual switch 15, there is adopted the dome type switch similarly to the Embodiment 1.

Figure 5:
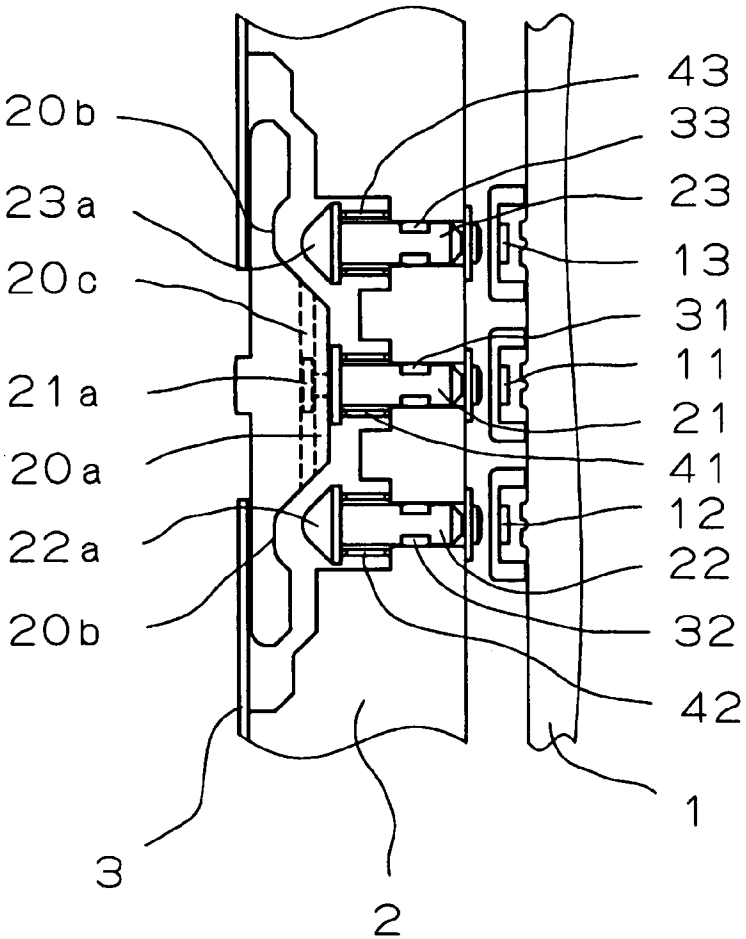
FIG. 5 is a sectional view of a 3-axle type composite switch of Embodiment 2 of the present invention when the button head exists in its intermediate position and is not pushed.

In the 3-axle type composite switch constituted like the above, under the neutral state of FIG. 5 in which the button head 20 exists in its intermediate position and is not pushed, the underside button axle 22 and the upside button axle 23 are moved to directions toward the escape parts 20*b* of the button head 20 by each of the bias springs 32 and 33, and their tip parts are separated from the underside individual switch 12 and the upside individual switch 13. Further, also a tip part of the center button axle 21 always engaging with the button head 20 is separated from the center individual switch 11. Accordingly, under this neutral state, the three individual switches 11-13 are all OFF.

Figure 6:
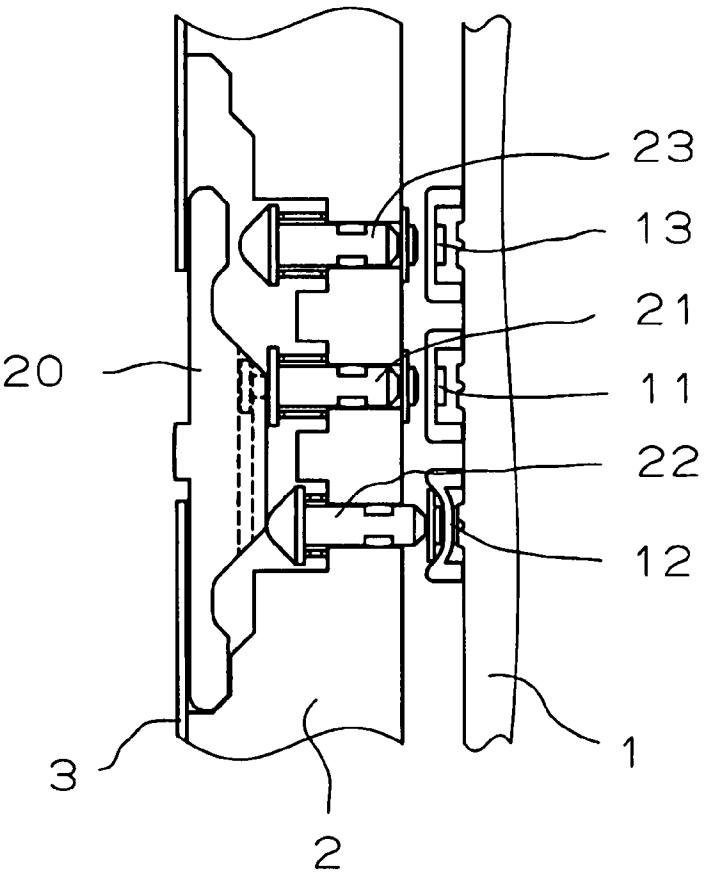
FIG. 6 is a sectional view of the 3-axle type composite switch of the Embodiment 2 of the present invention when the button head has been slid to its lower position.

In order to make only the underside individual switch 12 ON, the button head 20 is slid to the underside as shown in FIG. 6. Thereupon, the center protrusion part 20*a* of the button head 20 engages with the operating end part 22*a* of the underside button axle 22, thereby moving the button axle 22 to the individual switch side. By this, the tip part of the button axle 22 pushes the movable contact of the underside individual switch 12 to thereby cause it to contact with the fixed contact, so that the underside individual switch 12 is made ON. Under this state, both the center individual switch 11 and the upside individual switch 13 are OFF.

Figure 7:
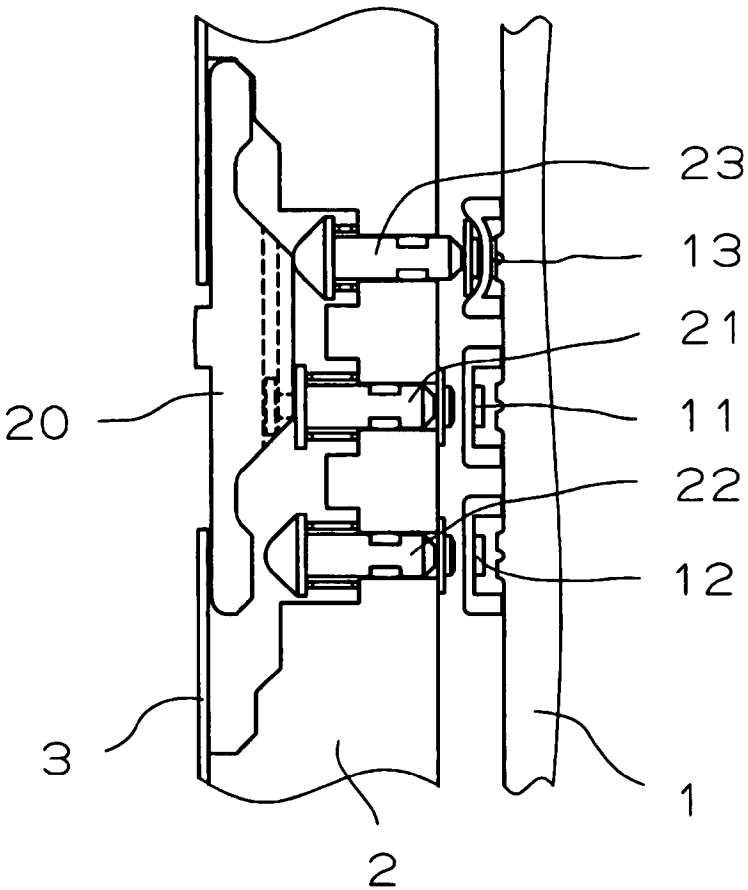
FIG. 7 is a sectional view of the 3-axle type composite switch of the Embodiment 2 of the present invention when the button head has been slid to its upper position.

In order to make only the upside individual switch 13 ON, the button head 20 is slid to the upside as shown in FIG. 7. Thereupon, the center protrusion part 20*a* of the button head 20 engages with operating end part 23*a* of the upside button axle 23, thereby moving the button axle 23 to the individual switch side. By this, the tip part of the button axle 23 pushes the movable contact of the upside individual switch 13 to thereby cause it to contact with the fixed contact, so that the upside individual switch 13 is made ON. Under this state, both the center individual switch 11 and the underside individual switch 12 are OFF.

Figure 8:
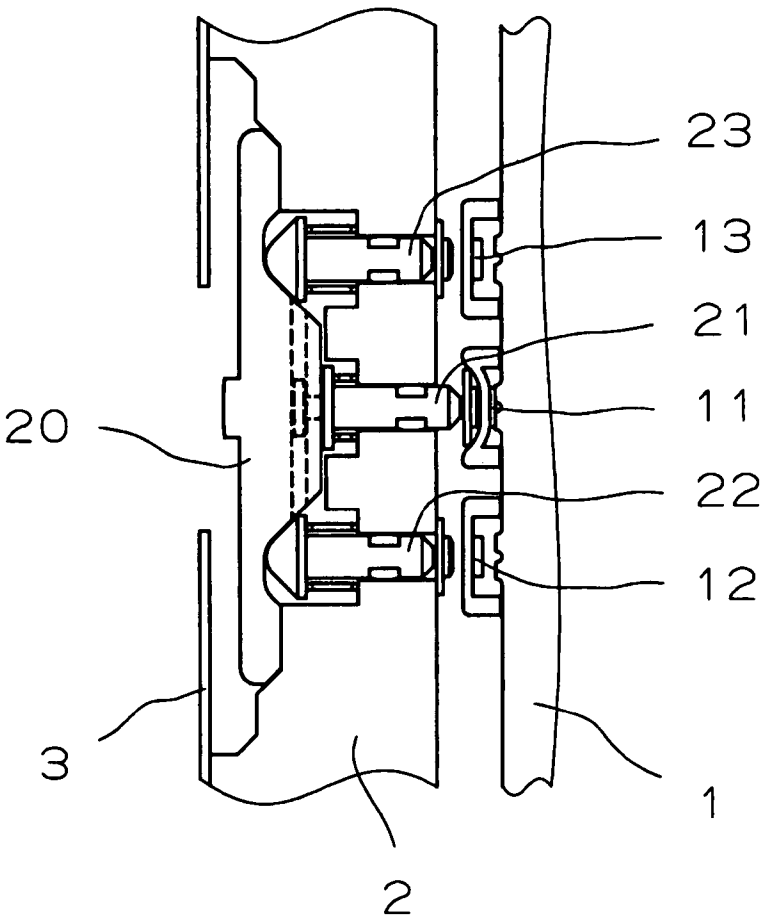
FIG. 8 is a sectional view of the 3-axle type composite switch of the Embodiment 2 of the present invention when the button head exists in its intermediate position and has been pushed.

In order to make only the center individual switch 11 ON, the button head 20 is slid to its intermediate position and pushed as shown in FIG. 8. Thereupon, the button axle 21 always engaging with the button head 20 is moved, and its tip part pushes the movable contact of the individual switch 11 to thereby cause it to contact with the fixed contact, so that the center individual switch 11 is made ON. Under this state, the operating end part 22*a* of the underside button axle 22 and the operating end part 23*a* of the upside button axle 23 are accommodated in the escape parts 20*b* in left and right of the button head 20, so that the underside button axle 22 and the upside button axle 23 are not pushed by the button head 20. Accordingly, both of the underside individual switch 12 and the upside individual switch 13 are OFF.

As mentioned above, the 3-axle type composite switch, of the Embodiment 2, constituted by possessing the center individual switch 11, the underside individual switch 12, the upside individual switch 13, the center button axle 21, the underside button axle 22, the upside button axle 23, and the button head 20 which can slide in the disposition direction of the individual switch and can be pushed in its intermediate position realizes four changeover states. That is, it is one realizing the four changeover states that only the underside individual switch 12 is made ON, only the upside individual switch 13 ON, only the center individual switch 11 ON, and the three individual switches 11, 12 and 13 are all OFF. Accordingly, in the scroll operation, it becomes unnecessary to continue to push the button head 20, so that the operation has become easy to be performed.

Embodiment 3

A composite switch of Embodiment 3 is a 5-axle type composite switch. That is, this composite switch is a 5-axle type composite switch possessing five individual switches of the center individual switch 11, the 1st underside individual switch 12, the 2nd underside individual switch 14, the 1st upside individual switch 13 and the 2nd upside individual switch 15 which have been disposed on the circuit substrate 1 with the predetermined spacing being provided, the button head 20 which can slide in the disposition direction of the individual switches and has been disposed in the armoring cover 2 while being made possible to be pushed in its intermediate position, and five button axles of the center button axle 21, the 1st underside button axle 22, the 2nd underside button axle 24, the 1st upside button axle 23 and the 2nd upside button axle 25 which are operated by the button head 20 and drive the individual switches 11-15. The button axles 21-25 are attached to through-holes of the armoring cover 2 respectively through waterproof packings 31-35, and to them there is given such a spring force as to be moved in the direction toward the button head 20 by each of bias springs 41-45. In short, the composite switch of the Embodiment 3 is one constituted by adding the 2nd underside individual switch 14, the 2nd upside individual switch 15, the 2nd underside button axle 24 and the 2nd upside button axle 25 to the 3-axle composite switch of the Embodiment 2 mentioned above.

The 2nd underside individual switch 14 is disposed in a more underside than the 1st underside individual switch 12. Further, the 2nd upside individual switch 15 is disposed in A more upside than the 1st up side individual switch 13. A spacing between the 1st underside individual switch 12 and the center individual switch 11 and a spacing between the 1st upside individual switch 13 and the center individual switch 11 are equally selected. A spacing between one pair of the underside individual switches 12 and 14 is a half of the spacing between the 1st underside individual switch 12 and the center individual switch 11. Similarly, a spacing between one pair of the upside individual switches 13 and 15 is a half of the spacing between the 1st upside individual switch 13 and the center individual switch 11. The 2nd underside button axle 24 is disposed in the armoring cover 2 with the spacing being provided as mentioned above so as to drive the 2nd underside individual switch 14. Similarly, the 2nd upside button axle 25 is disposed in the armoring cover 2 with the spacing being provided as mentioned above so as to drive the 2nd upside individual switch 15.

The button axles 21-25 are attached to the through-holes of the armoring cover 2 of the multifunction timepiece respectively through the waterproof packings 31-35, and to them there is given such a spring force as to be moved in the direction toward the button head 20 by each of the bias springs 41-45. The spacing between the 1st underside individual switch 12 and the center individual switch 11 and the spacing between the 1st upside individual switch 13 and the center individual switch 11 are equally selected. The spacing between the 1st underside individual switch 12 and the 2nd underside individual switch 14 is the half of the spacing between the 1st underside individual switch 12 and the center individual switch 11. Similarly, the spacing between the 1st upside individual switch 13 and the 2nd upside individual switch 15 is the half of the spacing between the 1st upside individual switch 13 and the center individual switch 11.

The button head 20 is a member whose length is a degree slightly exceeding four times of the spacing between the center button axle 21 and the underside button axle 22 and whose width is the degree slightly exceeding the diameter of each of these button axles. In the back face of the button head 20, there is formed in its center part the center protrusion part 20*a* whose section is trapezoid, and the escape parts 20*b* are formed in left and right. The width of the top face of the center protrusion part 20*a* in the disposition direction of the button axles is approximately equal to the spacing between the center button axle 21 and the underside button axle 22. In the center protrusion part 20*a*, there is formed one engaging groove 20*c* in the disposition direction of the button axles.

Further, the engaging groove 20*c* of the center protrusion part 20*a* is the groove of T-shaped section, whose depth from the top face is about the half of the center protrusion part 20*a* as shown in FIG. 15. In order to engage with the engaging part 20*c* of T-shaped section of the center protrusion part 20*a*, the operating end part 21*a* of the center button axle 21 becomes the end part of T-shaped section. The engaging groove 20*c* of T shaped section of the center protrusion part 20*a* always engages with the operating end part 21*a* of T-shaped section of the center button axle 21, but there is no fact that the center button axle 21 is pressed even if the button head 20 is slid up and down.

Each of the operating end part 22*a* of the 1st underside button axle 22, the operating end part 24*a* of the 2nd underside button axle 24, the operating part 23*a* of the 1st upside button axle 23 and the operating end part 25*a* of the 2nd upside button axle 25 is formed like the arc in section. This is for making it possible that the button head 20 having the center protrusion part 20*a* in the center and the escape parts 20*b* in both sides can smoothly slide while butting against the operating end part 22*a* of the underside button axle 22 and the operating end part 23*a* of the upside button axle 23.

For the center individual switch 11, the underside individual switches 12 and 24 and the upside individual switches 13 and 15, there is adopted the dome type switch similarly to the Embodiment 1.

Figure 9:
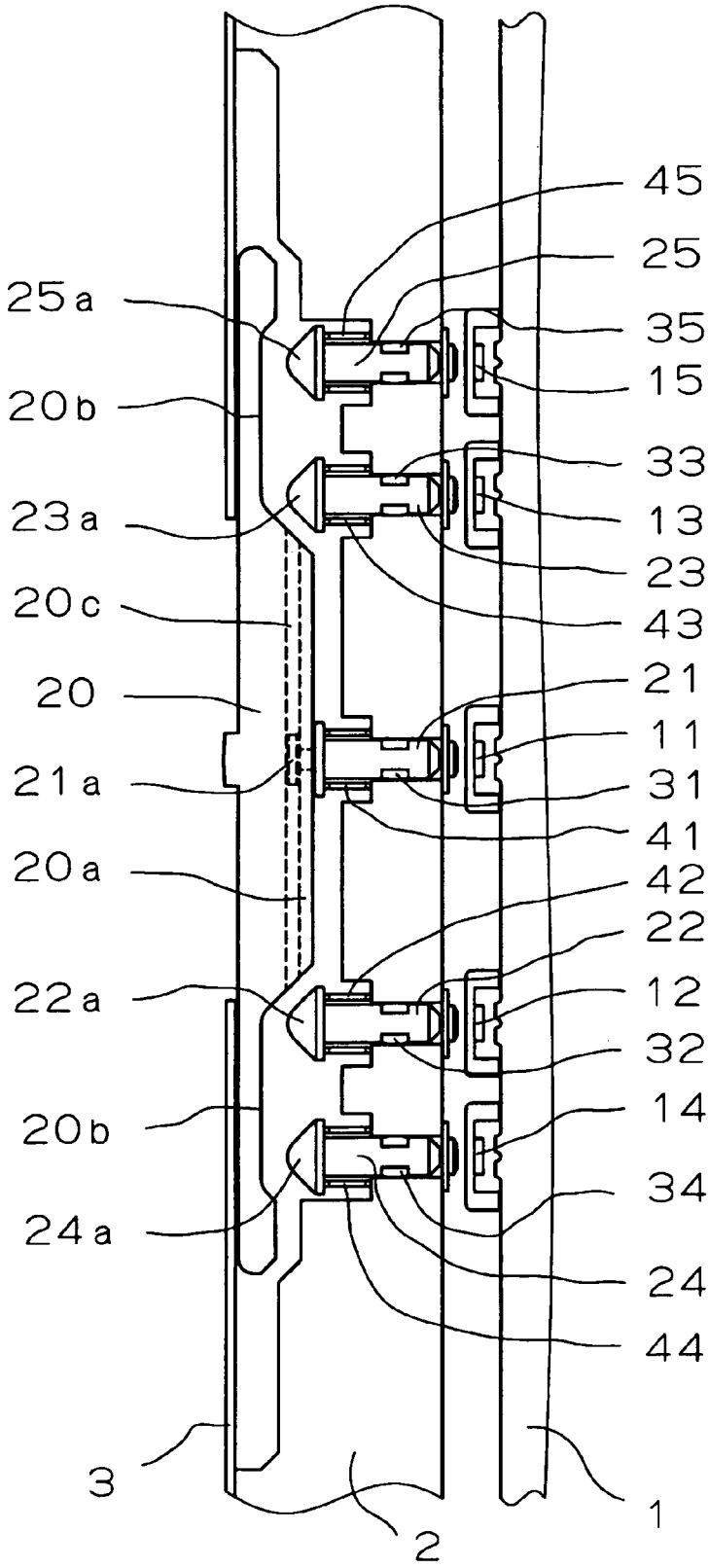
FIG. 9 is a sectional view of a 5-axle type composite switch of Embodiment 3 of the present invention when the button head exists in its intermediate position and is not pushed.

In the 5-axle type composite switch constituted like the above, under the neutral state of FIG. 9 in which the button head 20 exists in its intermediate position and is not pushed, the four button axles 22-25 in both sides of the center button axle 21 are moved to directions of the escape parts 20*b* of the button head 20 by each of the bias springs 32-35. Under this state, since the center protrusion part 20*a* of the button head 20 contacts with none of the operating end parts 22*a*-25*a* of the four button axles 22-25, their tip parts are separated from the four individual switches 12-15. Further, also the tip part of the center button axle 21 always engaging with the button head 20 is separated from the center individual switch 11. Accordingly, under this neutral state, the four individual switches 11-15 are all OFF.

Figure 10:
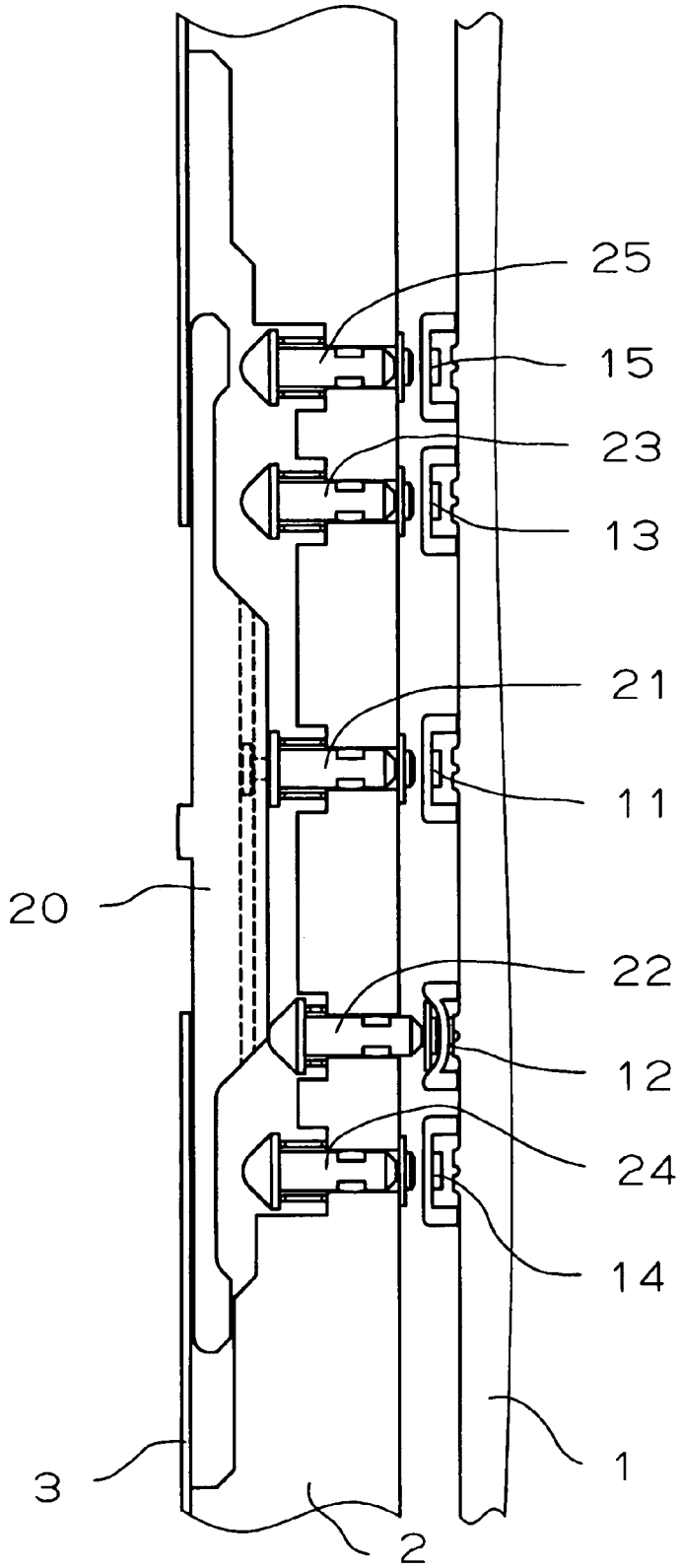
FIG. 10 is a sectional view of the 5-axle type composite switch of the Embodiment 3 of the present invention when the button head has been slid to its lower position by one stage.

In order to make only the 1st underside individual switch 12 ON, the button head 20 is slid to the underside by one stage as shown in FIG. 10. Thereupon, the center protrusion part 20*a* of the button head 20 engages with the operating end part 22*a* of the 1st underside button axle 22, thereby moving the button axle 22 to the individual switch side. By this, the tip part of the 1st underside button axle 22 pushes the movable contact of the 1st underside individual switch 12 to thereby cause it to contact with the fixed contact, so that the 1st underside individual switch 12 is made ON. Under this state, the center individual switch 11, the 2nd underside individual switch 14, the 1st upside individual switch 13 and the 2nd upside individual switch 15 are all OFF.

Figure 11:
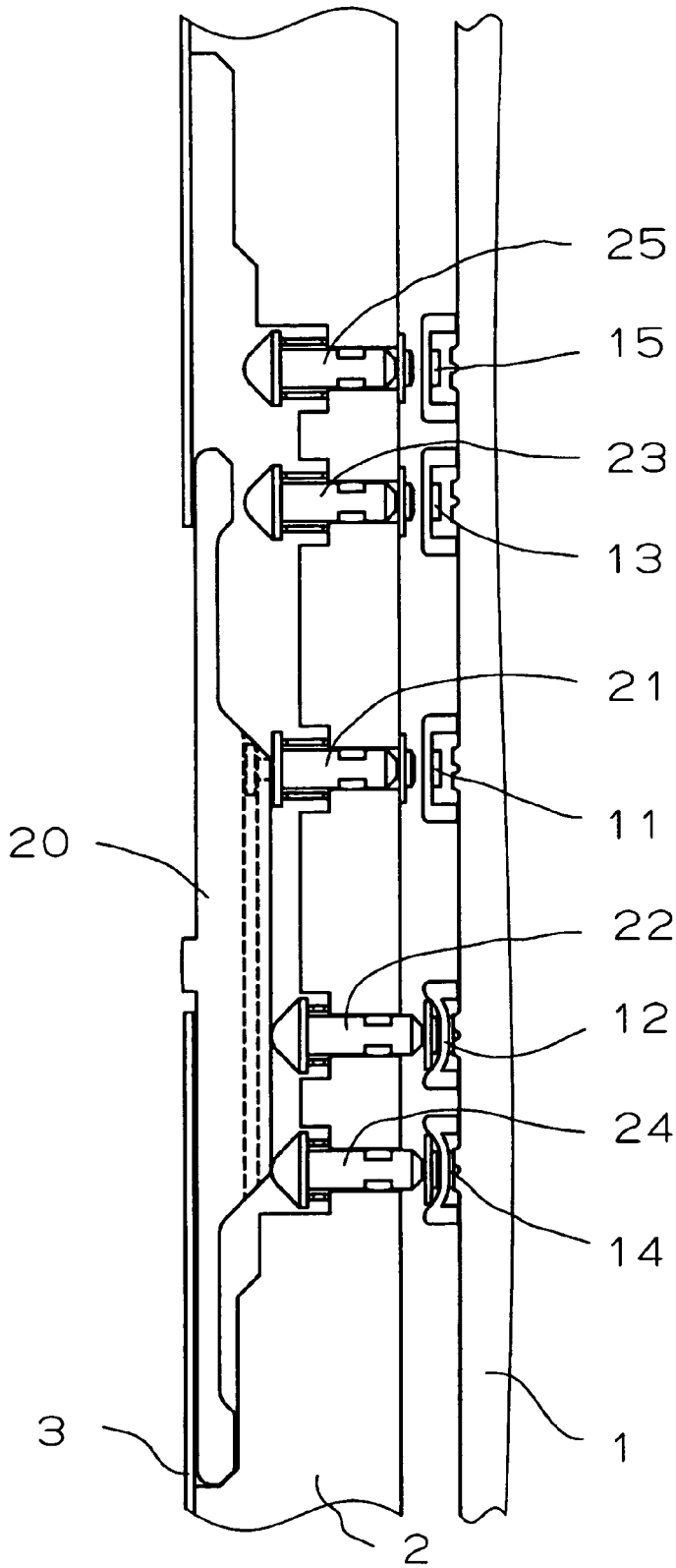
FIG. 11 is a sectional view of the 5-axle type composite switch of the Embodiment 3 of the present invention when the button head has been slid to its lower position by two stages.

In order to make both the 1st underside individual switch 12 and the 2nd underside individual switch 14 ON, the button head 20 is slid to the underside by two stages as shown in FIG. 11. Thereupon, the center protrusion part 20*a* of the button head 20 engages with both the operating end parts 22*a* and 24*a* of the 1st underside button axle 22 and the 2nd underside button axle 24, thereby moving the button axles 22 and 24 to the individual switch side. By this, the tip parts of the button axles 22 and 24 push the respective movable contacts of the underside individual switches 12 and 14 to thereby cause them to contact with the fixed contacts, so that both of the 1st underside individual switch 12 and the 2nd underside individual switch 14 are made ON. Under this state, the center individual switch 11, the 1st upside individual switch 13 and the 2nd upside individual switch 15 are all OFF.

Figure 13:
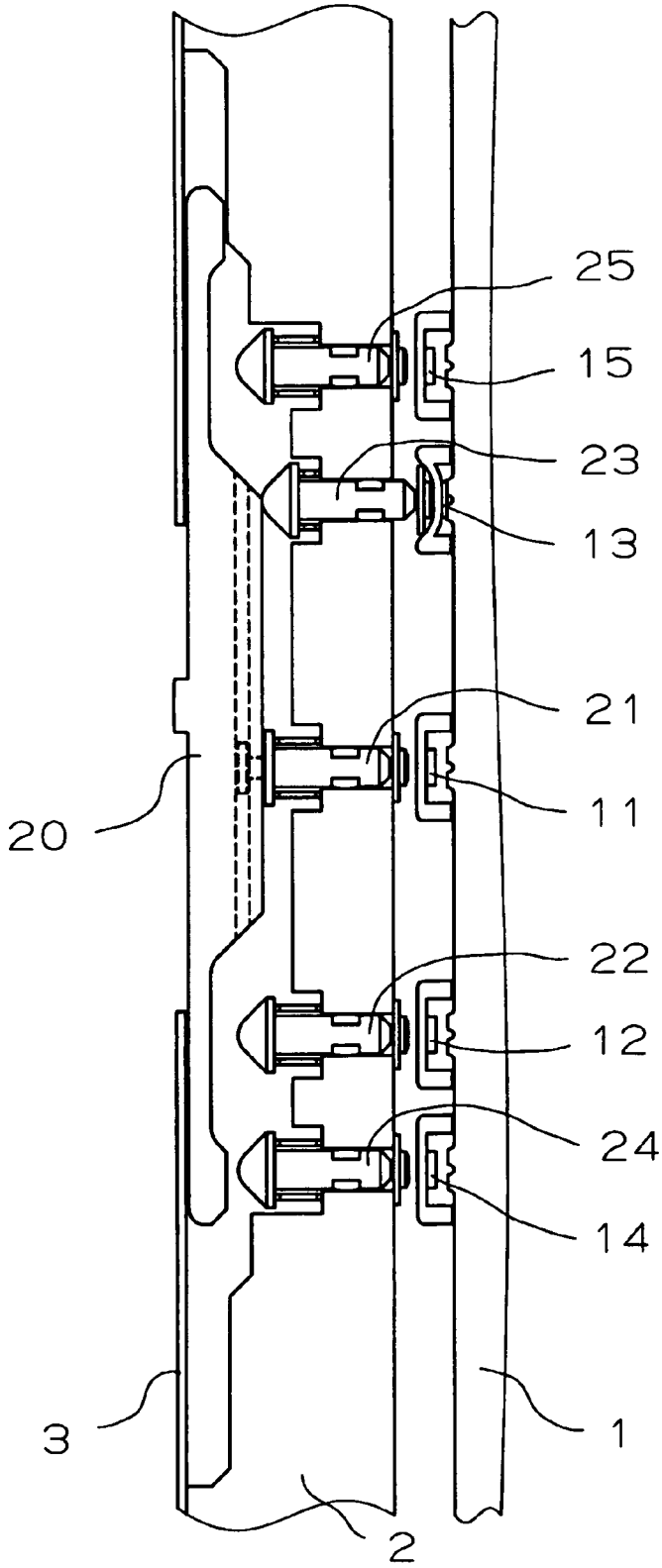
FIG. 13 is a sectional view of the 5-axle type composite switch of the Embodiment 3 of the present invention when the button head has been slid to its upper position by one stage.

In order to make only the 1st upside individual switch 13 ON, the button head 20 is slid to the upside by one stage as shown in FIG. 13. Thereupon, the center protrusion part 20*a* of the button head 20 engages with the operating end part 23*a* of the 1st upside button axle 23, thereby moving the button axle 22 to the individual switch side. By this, the tip part of the 1st upside button axle 23 pushes the movable contact of the 1st upside individual switch 13 to thereby cause it to contact with the fixed contact, so that the 1st upside individual switch 13 is made ON. Under this state, the center individual switch 11, the 1st underside individual switch 12, the 2nd underside individual switch 14 and the 2nd upside individual switch 15 are all OFF.

Figure 14:
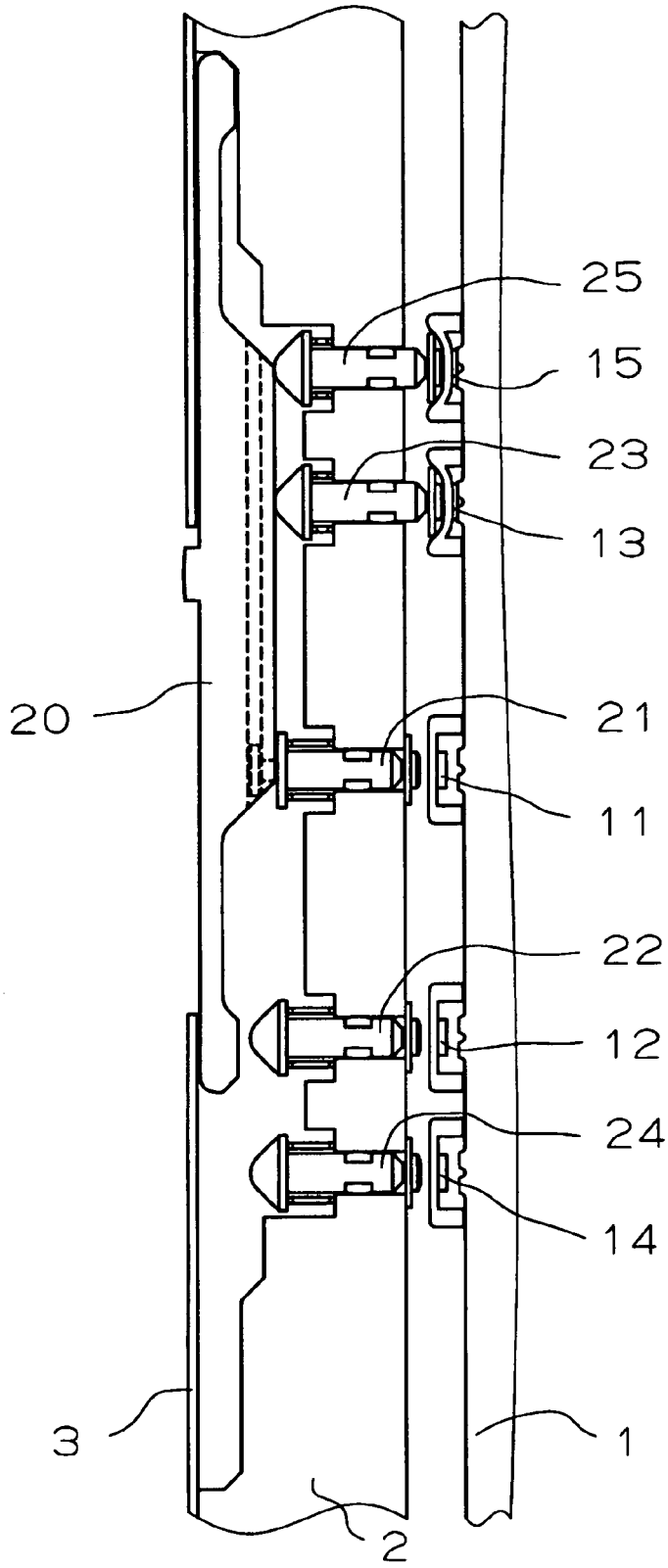
FIG. 14 is a sectional view of the 5-axle type composite switch of the Embodiment 3 of the present invention when the button head has been slid to its upper position by two stages.

In order to make both the 1st upside individual switch 13 and the 2nd upside individual switch 15 ON, the button head 20 is slid to the upside by two stages as shown in FIG. 14. Thereupon, the center protrusion part 20*a* of the button head 20 engages with both the operating end parts 23*a* and 25*a* of the 1st upside button axle 23 and the 2nd upside button axle 25, thereby moving the button axles 23 and 25 to the individual switch side. By this, the tip parts of the button axles 23 and 25 push the respective movable contacts of the upside individual switches 13 and 15 to thereby cause them to contact with the fixed contacts, so that both the 1st upside individual switch 13 and the 2nd upside individual switch 15 are made ON. Under this state, the center individual switch 11, the 1st underside individual switch 12 and the 2nd underside individual switch 14 are all OFF.

Figure 12:
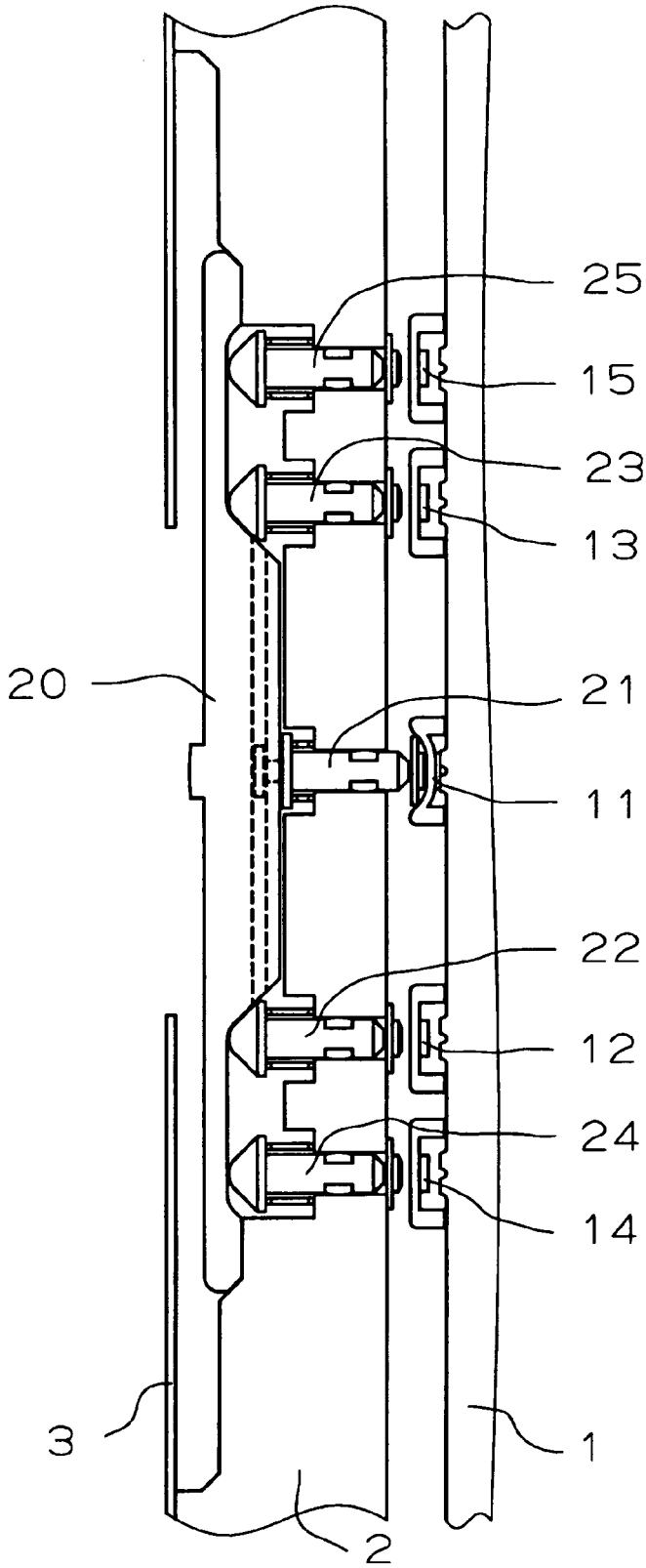
FIG. 12 is a sectional view of the 5-axle type composite switch of the Embodiment 3 of the present invention when the button head exists in its intermediate position and has been pushed.

In order to make only the center individual switch 11 ON, the button head 20 is slid to its intermediate position and pushed as shown in FIG. 12. Thereupon, the button axle 21 always engaging with the button head 20 is moved, and its tip part pushes the movable contact of the individual switch 11 to thereby cause it to contact with the fixed contact, so that the center individual switch 11 is made ON. Under this state, the operating end parts 22*a* and 24*a* of the underside button axles 22 and 24 and the operating end parts 23*a* and 25*a* of the upside button axles 23 and 25 are accommodated in the escape parts 20*b* in left and right of the button head 20, so that the underside button axles 12 and 14 and the upside button axles 23 and 25 are not pushed by the button head 20. Accordingly, the underside individual switches 12 and 14 and the upside individual switches 13 and 15 are all OFF.

As mentioned above, the 5-axle type composite switch, of the Embodiment 3, constituted by possessing the center individual switch 11, the underside individual switches 12 and 14, the upside individual switches 13 and 15, the center button axle 21, the underside button axles 22 and 24, the upside button axles 23 and 25, and the button head 20 which can slide in the disposition direction of the individual switch and can be pushed in its intermediate position realizes six changeover states. That is, it is one realizing the six changeover states that only the 1st underside individual switch 12 is ON, both the 1st underside individual switch 12 and the 2nd underside individual switch 14 ON, only the 1st upside individual switch 13 ON, both the 1st upside individual switch 13 and the 2nd upside individual switch 15 ON, only the center individual switch 11 ON, and the five individual switches 11-15 all OFF. Accordingly, in the scroll operation, it becomes unnecessary to continue to push the button head 20, so that the operation has become easy to be performed.

By the present invention, there has been provided a simple jog switch type composite switch in which a letter scroll operation is easy and which has the waterproofness. Accordingly, by adopting the composite switch concerning the present invention, it has become possible to realize a multifunction electronic timepiece or electronic equipment whose operation is easy and which has the watweproofness. Further, since merely the waterproof packing is used, it has become possible to simply realize a waterproof structure.

What is claimed is:

1. A composite switch comprising:

a plural of individual switches disposed in one row on a 1st support member;

a plural of button axles disposed while corresponding to each of the plural individual switches and being given spring forces; and a button head having a back face in which there have been formed a center protrusion part and left and right escape parts and disposed such that operating end parts of the plural button axles are selectively pressed by the center protrusion part;

wherein the plural button axles are attached to through-holes of a 2nd support member while being made possible to perform a reciprocal movement in an axial direction and through waterproof packings, and the button head is attached to the 2nd support member while being made possible to slide in a disposition direction of the button axles and to be pushed in an intermediate position.

2. A composite switch comprising:

two individual switches disposed in one row on a 1st support member;

two button axles disposed while corresponding to each of the two individual switches and being given spring forces; and a button head having a back face in which there have been formed a center protrusion part and left and right escape parts and disposed such that operating end parts of the button axles are selectively pressed by the center protrusion part;

wherein the button axles are attached to through-holes of a 2nd support member while being made possible to perform a reciprocal movement in an axial direction and through waterproof packings, and the button head is attached to the 2nd support member while being made possible to slide in a disposition direction of the button axles.

3. A composite switch according to claim 2, wherein the operating end parts of the two button axles are like an arc in section.

4. A composite switch according to claim 1, wherein the 1st support member is a circuit substrate, and the 2nd support member is an armoring case.

5. A composite switch according to claim 2, wherein the 1st support member is a circuit substrate, and the 2nd support member is an armoring case.

6. An electronic equipment possessing a composite switch according to claim 1.

7. An electronic equipment possessing a composite switch according to claim 2.

8. An electronic timepiece possessing a composite switch according to claim 1.

9. An electronic timepiece possessing a composite switch according to claim 2.

* * * * *